US007401706B2

(12) United States Patent
Shingle

(10) Patent No.: US 7,401,706 B2
(45) Date of Patent: Jul. 22, 2008

(54) CLOSURE AND PACKAGE HAVING CHILD-RESISTANT AND NON-CHILD-RESISTANT MODES OF OPERATION

(75) Inventor: John M. Shingle, Perrysburg, OH (US)

(73) Assignee: Rexam Prescription Products Inc., Perrysburg, OH (US)

( * ) Notice: Subject to any disclaimer, the term of this patent is extended or adjusted under 35 U.S.C. 154(b) by 681 days.

(21) Appl. No.: 10/952,143

(22) Filed: Sep. 27, 2004

(65) Prior Publication Data

US 2006/0070970 A1 Apr. 6, 2006

(51) Int. Cl.
*B65D 55/02* (2006.01)
*B65D 45/00* (2006.01)

(52) U.S. Cl. ..... 215/220; 215/221; 215/213; 215/274

(58) Field of Classification Search ..... 215/332, 215/220, 43–45, 230, 203, 321, 206, 228, 215/334, 221, 213, 274, 218, 216, 217
See application file for complete search history.

(56) References Cited

U.S. PATENT DOCUMENTS

| | | | | |
|---|---|---|---|---|
| 3,968,894 | A | 7/1976 | Herrmann | |
| 4,144,983 | A | 3/1979 | Pauls et al. | |
| 4,452,364 | A | 6/1984 | Kay | |
| 5,370,251 | A | 12/1994 | Buono | |
| 5,445,283 | A * | 8/1995 | Krautkramer | 215/218 |
| 5,544,768 | A | 8/1996 | Gargione | |
| 5,579,934 | A | 12/1996 | Buono | |
| 5,899,348 | A | 5/1999 | Konefal et al. | |
| 6,076,689 | A | 6/2000 | Vassallo | |
| 6,206,216 | B1 | 3/2001 | Stalions | |
| 6,327,770 | B1 | 12/2001 | Konefal et al. | |
| 6,508,373 | B1 * | 1/2003 | Robinson | 215/209 |
| 2002/0027119 | A1 | 3/2002 | Miceli et al. | |
| 2002/0027120 | A1 | 3/2002 | Miceli et al. | |
| 2005/0150857 | A1 * | 7/2005 | Brozell et al. | 215/204 |

FOREIGN PATENT DOCUMENTS

| | | |
|---|---|---|
| WO | WO 01/64529 | 9/2001 |

* cited by examiner

*Primary Examiner*—Robin Hylton
(74) *Attorney, Agent, or Firm*—Reising, Ethington, Barnes, Kisselle, P.C.

(57) ABSTRACT

A closure having child-resistant and non-child-resistant modes of operation includes a plastic inner shell having a skirt with at least one internal thread, an external bead on the skirt and a circumferential array of teeth on the bead. A plastic outer shell has a skirt externally encircling the skirt of the inner shell. The outer shell has an internal bead on its skirt, a circumferential array of first teeth on one side of the internal bead, a circumferential array of second teeth on the other side of the internal bead, and at least one third engagement element adjacent to an edge of the skirt. The inner shell is positionable within the outer shell in child-resistant and non-child-resistant positions, in which the teeth on the inner skirt engage the first or second teeth on the outer shell.

3 Claims, 2 Drawing Sheets

CLOSURE AND PACKAGE HAVING CHILD-RESISTANT AND NON-CHILD-RESISTANT MODES OF OPERATION

The present invention relates to child-resistant closures and packages, such as medicinal packages for example, and to methods of making such packages, in which the closure and package have child-resistant and non-child-resistant modes of operation.

BACKGROUND AND SUMMARY OF THE INVENTION

U.S. Pat. Nos. 5,899,348, 6,039,195 and 6,327,770 disclose closure and container packages that are particularly well-suited for prescription applications. The container includes a sidewall with an externally threaded finish and a deflectable release element cantilevered from the finish on a side of the threads remote from the open mouth of the container. The closure includes a base wall with an internally threaded peripheral skirt having locking lugs at the edge of the skirt remote from the base wall. These locking lugs on the skirt cooperate with a locking lug on the deflectable release element of the container to secure the closure to the container in a child-resistant mode of operation. To release the closure, the release element is deflected downwardly toward the container sidewall to move the locking lug on the release element out of engagement with the locking lug on the closure skirt. A dome extends from the inner periphery of the base wall and has an external thread that is adapted to be received within the open mouth of the container in an inverted non-child-resistant mode of operation of the closure. A general object to the present invention is to provide a closure and package of the general type disclosed in the noted patents, in which the closure is convertible between child-resistant and non-child-resistant modes of operation without inverting the closure with respect to the container finish.

A closure having child-resistant and non-child-resistant modes of operation, in accordance with a first aspect of a presently preferred embodiment of the invention, includes a plastic inner shell having an upper end, a skirt with at least one internal thread, at least one external bead on the skirt and at least one external engagement element on the skirt. A plastic outer shell has a skirt externally encircling the skirt of the inner shell. The outer shell has at least one internal bead on its skirt, at least one internal first engagement element on a side of the internal bead adjacent to the upper end of the inner shell, at least one second engagement element on a side of the internal bead remote from the upper end of the inner shell, and at least one third engagement element adjacent to an edge of the skirt remote from the upper end of the inner shell. The inner shell is positionable within the outer shell at a non-child-resistant first position with the external bead on the inner shell disposed on a side of the internal bead on the outer shell remote from the base wall of the inner shell, and with the second engagement element on the outer shell disposed for engagement with the external engagement element on the inner shell. The inner shell is positionable within the outer shell at a child-resistant second position with the external bead on the inner shell disposed on a side of the internal bead of the outer shell proximate to the base wall of the inner shell, and with the external engagement element of the inner shell disposed for engagement with the internal first engagement element of the outer shell.

In the preferred embodiment in accordance with this first aspect of the invention, the internal bead on the outer shell is disposed between circumferentially continuous internal channels on the skirt of the outer shell, the first internal engagement element on the outer shell includes a circumferential array of teeth within a first of the channels, and the second internal engagement element on the outer shell includes a circumferential array of teeth within a second of the internal channels. The external engagement element on the inner shell in the preferred embodiment of the invention includes a circumferential array of teeth on the external bead, which are engageable with the teeth in the first and second internal channels of the outer shell in the child-resistant and non-child-resistant modes of operation respectively.

A closure in accordance with a second aspect of the present invention includes a plastic inner shell having a skirt with at least one internal thread, and a plastic outer shell having a skirt externally encircling the skirt of the inner shell and at least one engagement element adjacent to an edge of the skirt. The skirts of the inner and outer shells have opposed radially facing surfaces. One of these surfaces has a bead with at least one tooth. The other of the surfaces has a bead, with at least one first tooth disposed above the bead and at least one second tooth disposed below the bead. The inner shell is positionable within the outer shell in a first mode of operation such that the bead on the one surface is positioned below the bead on the other surface, and the at least tooth on the bead of the first surfaces is disposed to engage the at least one second tooth on the other surface. The inner shell is positionable within the outer shell in a second mode of operation such that the bead on the one surface is positioned above the bead on the other surface, and the at least one tooth on the bead of the first surface is disposed to engage the at least one first tooth on the other surface. In the preferred embodiment of the invention, the at least one tooth on the bead includes a circumferential array of teeth on the bead, the at least one first tooth includes a circumferential array of first teeth, and the at least one second tooth includes a circumferential array of second teeth. In the preferred embodiment, the bead with the circumferential array of teeth is an external bead on the inner shell, and the bead with spaced circumferential arrays of first and second teeth are an internal bead and internal arrays of teeth on the skirt of the outer shell.

BRIEF DESCRIPTION OF THE DRAWINGS

The invention, together with additional objects, features, advantages and aspects thereof, will best be understood from the following description, the appended claims and the accompanying drawings, in which:

DETAILED DESCRIPTION OF PREFERRED EMBODIMENTS

Figure 1:
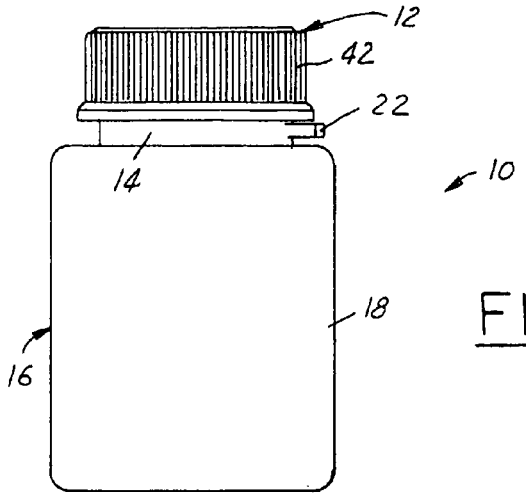
FIG. 1 is a side elevational view of a package in accordance with one presently preferred embodiment of the invention.

FIG. 1 illustrates a package 10 in accordance with one presently preferred embodiment of the invention as including a closure 12 removably received on the finish 14 of a container 16. Container 16 (FIGS. 1-3 and 6) in the illustrated embodiment of the invention includes a cylindrical finish 14 that is integrally connected to a container body 18. A deflectable release element 22 is integrally cantilevered from the external surface of finish 14. One or more external threads (or thread segments) 24 are provided on finish 14 between release element 22 and the open mouth of the container. To the extent thus far described, container 16 of the illustrated exemplary embodiment is similar to that disclosed in U.S. application Ser. No. 10/378,434. Container 16 may be made in any suitable molding operation, such as a reheat blow molding operation as disclosed in U.S. application Ser. No. 10/768,331.

Figure 4:
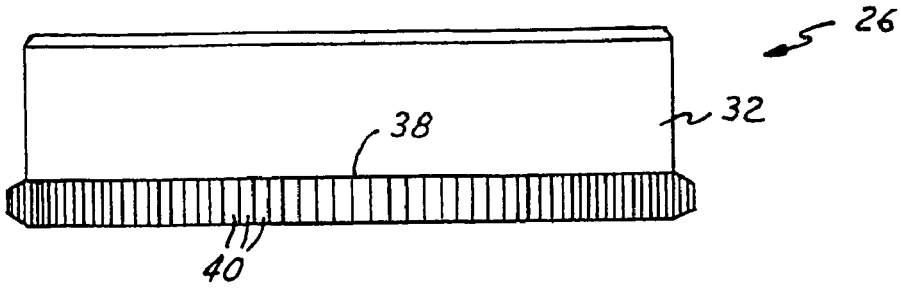
FIG. 4 is an external side elevational view of the inner shell in the closure of FIGS. 1-3.
Figure 5:
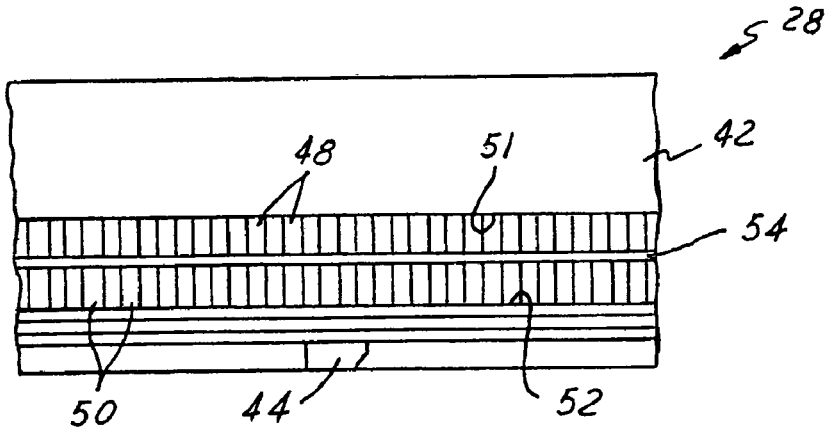
FIG. 5 is a fragmentary inside elevational view of the outer shell in the closure of FIGS. 1-3.
Figure 6:
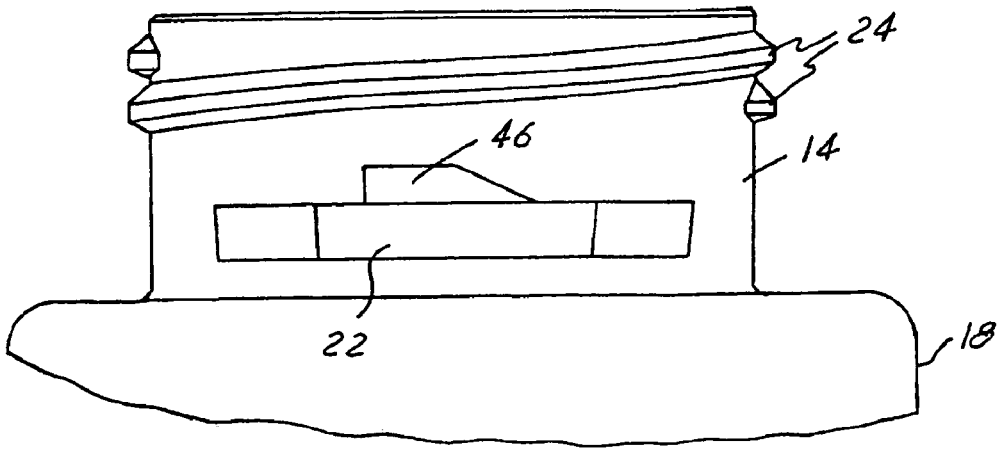
FIG. 6 is a fragmentary elevational view of the container in the package of FIGS. 1-3.

Closure 12 includes a plastic inner shell 26 (FIGS. 2-4) and a plastic outer shell 28 (FIGS. 2-3 and 5) telescopically received over inner shell 26. Inner shell 26 includes a base wall 30 having an external peripheral skirt 32. Skirt 32 has one or more internal threads (or thread segments) 34 adapted to engage external threads 24 on container finish 14. The illustrated embodiment of the invention also has an annular wall 36 that extends from base wall 30 radially inwardly of skirt 32 for plug-sealing engagement within the mouth of container finish 14, although other suitable sealing means may be provided. An external circumferential bead 38 extends around skirt 32 at a position spaced from base wall 30, such as adjacent to the edge of skirt 32 in the exemplary embodiment of the invention. A circumferential array of angularly spaced radially outwardly extending teeth 40 are provided around external bead 38.

Outer shell 28 includes a cylindrical skirt 42. At least one engagement element or lug 44 is provided adjacent to the lower edge of skirt 42 for engagement with a resilient locking lug 46 on container release element 22. (Directional words such as "upper" and "lower" are employed by way of description and not limitation with respect to the upright orientation of the closure, container and package illustrated in the drawings. Directional words such as "inner," "outer" and "radial" are employed by way of description and not limitation with respect to the axis of the container finish or the closure skirts as appropriate.) An upper circumferential array of angularly spaced radially inwardly extending axial teeth 48 and a lower circumferential array of angularly spaced radially inwardly extending axial teeth 50 are provided on the inside surface of skirt 42. In the preferred embodiment of the invention illustrated in the drawings, teeth 48,50 are provided in respective internal channels 51, 52 that extend around the inside surface of skirt 42. Channels 51, 52 are spaced from each other axially on skirt 42, and are separated from each other by an internal bead 54 on skirt 42. The axial dimensions of channels 51, 52 on outer skirt 42 and bead 38 on inner skirt 32 are such that external bead 38 may be received by snap-fit selectively within either channel 51 or channel 52.

Figure 2:
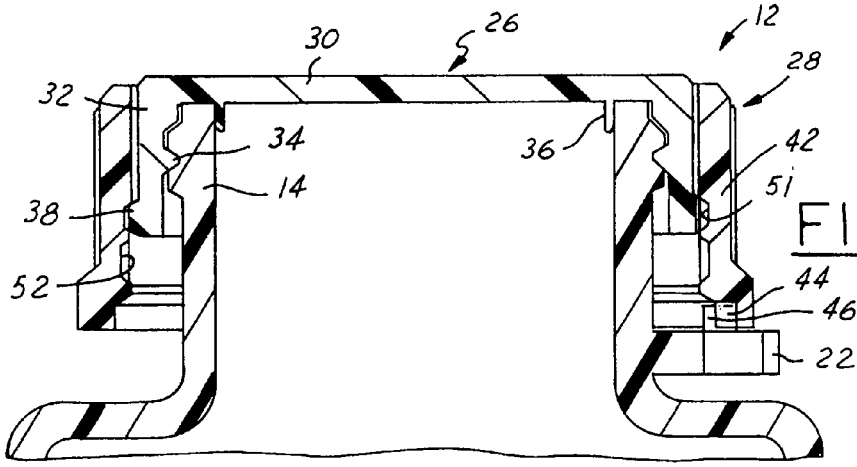
FIG. 2 is a fragmentary sectional view of the package of FIG. 1 in a child-resistant mode of operation.
Figure 3:
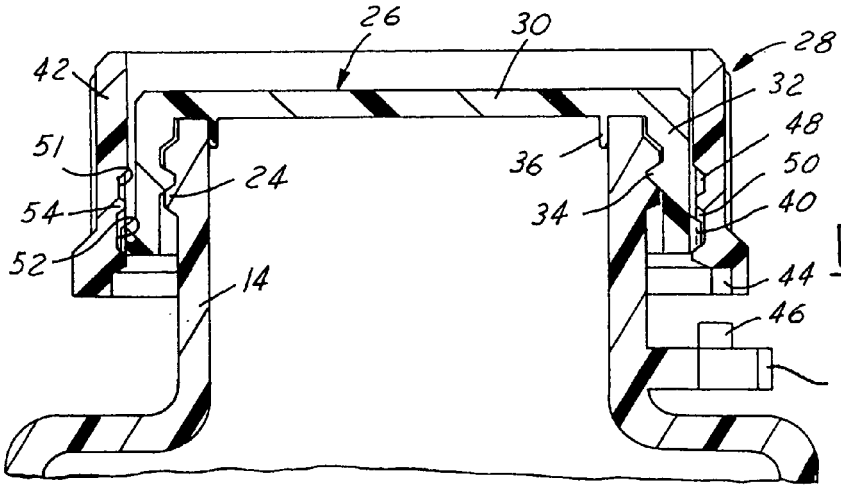
FIG. 3 is a fragmentary sectional view similar to that of FIG. 2 but showing the closure and package in a non-child-resistant mode of operation.

In a child-resistant mode of operation of closure 12 illustrated in FIGS. 1 and 2, external bead 38 on skirt 32 of inner shell 26 is received by snap-fit within upper internal channel 51 on skirt 42 of outer shell 28. The lower edge of outer shell 28 thus extends downwardly from inner shell 26 so as to position shell lug 44 for engagement with locking lug 46 on container release element 22. In order to remove the closure from the container finish, release element 22 must be deflected downwardly so that locking lug 44 on skirt 42 can clear locking lug 46 on release element 22. Outer shell 28 then may be rotated in the counterclockwise unthreading direction, and such rotation is imparted to inner shell 26 by means of the engaged teeth 40 on bead 38 of inner shell 26 and teeth 48 in channel 51 of outer shell 28. When the closure is thereafter threaded onto the finish, lug 44 cams lug 46 downwardly and snaps over lug 46, as described in the above-noted patents.

To adapt closure 12 for non-child-resistant operation (FIG. 3), inner shell 26 and outer shell 28 are moved with respect to each other so that external bead 38 on inner shell moves out of internal channel 51 on outer channel 28, over bead 54, and into channel 52 adjacent to the lower edge of outer shell 28. With bead 28 received by snap-fit within channel 52, teeth 40 on bead 38 are engaged with teeth 50 within channel 52 and locking lug 44 on outer shell 28 is held clear of container release element 22. Thus, closure 12 can be threaded directly onto and off of container finish 14 in a non-child-resistant mode of operation. The closure can be returned to the child-resistant configuration by snapping bead 38 over bead 54 and back into channel 51.

There thus have been disclosed a closure, a package and a method of making a closure and package that fully satisfy all of the objects and aims previously set forth. The invention has been disclosed in conjunction with a presently preferred embodiment thereof, and a number of modifications and variations have been discussed. Other modifications and variations readily will suggest themselves to persons of ordinary skill in the art in view of the foregoing description. For example, the internal teeth 48, 50 on outer shell 28 could be provided on internal beads, and external teeth 40 on inner shell 26 could be provided in a corresponding channel on the outer surface of the inner shell. Indeed, the positions of the beads and channels could be reversed, which is to say that spaced beads or channels could be provided on inner shell 26 while a single internal bead or channel could be provided on outer shell 28. The invention is intended to embrace all such modifications and variations as fall within the spirit and broad scope of the appended claims.

The invention claimed is:

1. A package having child-resistant and non-child-resistant modes of operation, which includes:

a plastic container having a cylindrical finish with an open end, at least one external thread on said finish, and a manually deflectable release element externally cantilevered from said finish on a side of said at least one thread remote from said open end, and a plastic closure that includes:

a plastic inner shell having an upper end, a skirt with at least one internal thread for engagement with said at least one external thread on said finish, at least one external bead on said skirt and at least one external engagement element on said skirt, a plastic outer shell having a skirt externally encircling said skirt of said inner shell, at least one internal bead on said skirt, at least one internal first engagement element on said skirt on a side of said internal bead adjacent to said upper end, at least one internal second engagement element on said skirt on a side of said internal bead remote from said upper end, and at least one third engagement element adjacent to an edge of said skirt remote from said upper end of said inner shell for engagement with said deflectable release element in a child-resistant mode of operation, said inner shell being positionable within said outer shell in a non-child-resistant first position with said external bead on said inner shell disposed on a side of said internal bead of said outer shell remote from said upper end, said internal second engagement element on said outer skirt disposed for engagement with said external engagement element and said third engagement element on said skirt of said outer shell spaced from engagement with said release element such that said closure can be unthreaded from said container finish without deflecting said release element, and said inner shell being positionable within said outer shell in a child-resistant second position with said external bead on said inner shell disposed on a side of said internal bead of said outer shell proximate to said upper end of said inner shell, said external engagement element on said inner skirt disposed for engagement with said internal first engagement element of said outer skirt, and said third engagement element on said skirt of said outer shell positioned for engagement with said release element such that said closure cannot be unthreaded from said container finish without deflecting said release element out of engagement with said third engagement element.

2. The package set forth in claim 1 wherein said at least one internal bead on said outer shell is disposed between circumferentially continuous internal channels on said outer shell, wherein said at least one first internal engagement element comprises a circumferential array of teeth within a first of said channels, and wherein said at least one second internal engagement element comprises a circumferential array of teeth within a second of said internal channels.

3. The package set forth in claim 2 wherein said at least one external engagement element on said inner shell includes a circumferential array of teeth on said at least one external bead.

* * * * *